United States Patent [19]

Slawinski

[11] 3,939,564

[45] Feb. 24, 1976

[54] ADJUSTABLE GRID LINE DEVICE

[76] Inventor: Sr. Slawinski, 1537 Castle Hill Ave., Bronx, N.Y. 10462

[22] Filed: Feb. 20, 1975

[21] Appl. No.: 551,100

[52] U.S. Cl. ..... 33/1 K; 33/103

[51] Int. Cl.[2] ..... B43L 13/00

[58] Field of Search .. 33/1 K, 103, 277, 95, DIG. 9; 356/126

[56] References Cited

UNITED STATES PATENTS

| | | | |
|---|---|---|---|
| 353,919 | 12/1886 | Charman | 33/1 K |
| 1,183,977 | 5/1916 | Hoefle | 355/126 X |
| 1,509,703 | 9/1924 | Bourgeois | 33/95 |
| 1,622,229 | 3/1927 | Ormiston | 33/1 K |
| 1,821,252 | 9/1931 | Woods | 33/277 |
| 2,370,741 | 3/1945 | McDonnell | 33/103 |
| 2,451,207 | 10/1948 | Ferguson | 33/DIG. 9 |

*Primary Examiner*—William D. Martin, Jr.
*Attorney, Agent, or Firm*—Homer J. Bridger

[57] ABSTRACT

This device consists primarily of parallel spaced apart bars which through brackets, bolt, spring and wingnut fastenings will adjust to adapt to a painting canvas, the parallel members having equally spaced apart slot means in which will be received thread so as to form grid lines for the purpose of copying, enlarging or decreasing photographs, paintings, pictures, plans and the like from one area to another.

1 Claim, 4 Drawing Figures

ADJUSTABLE GRID LINE DEVICE

This invention relates to instruments for enlarging and reducing prints, and more particularly to an adjustable grid-lined device.

It is therefore the principal object of this invention to provide an adjustable grid line device which by thread means forming a grid composing squares, will serve the purpose for copying, enlarging or decreasing photographs, pictures and the like.

Another object of this invention is to provide an adjustable grid line device which will have parallel spaced apart L-shaped members slotted along a longitudinal edge to receive the threads that will form the grid lines.

Still another object of this invention is to provide a grid line device of the type described which will be secured together to form a slideable bar arrangement which will adapt to various sized canvases or other material, the opposite sides remaining parallel with each other throughout any of the adjustments through the use of spring loaded bolt fasteners receiving wing-nut fasteners which will render the frame secure in any desired dimension required.

Other objects of the invention are to provide an adjustable grid line device which is simple in design, inexpensive to manufacture, rugged in construction, easy to use and efficient in operation.

These and other objects will become readily evident upon a study of the following specification together with the accompanying drawing wherein.

Figure 1:
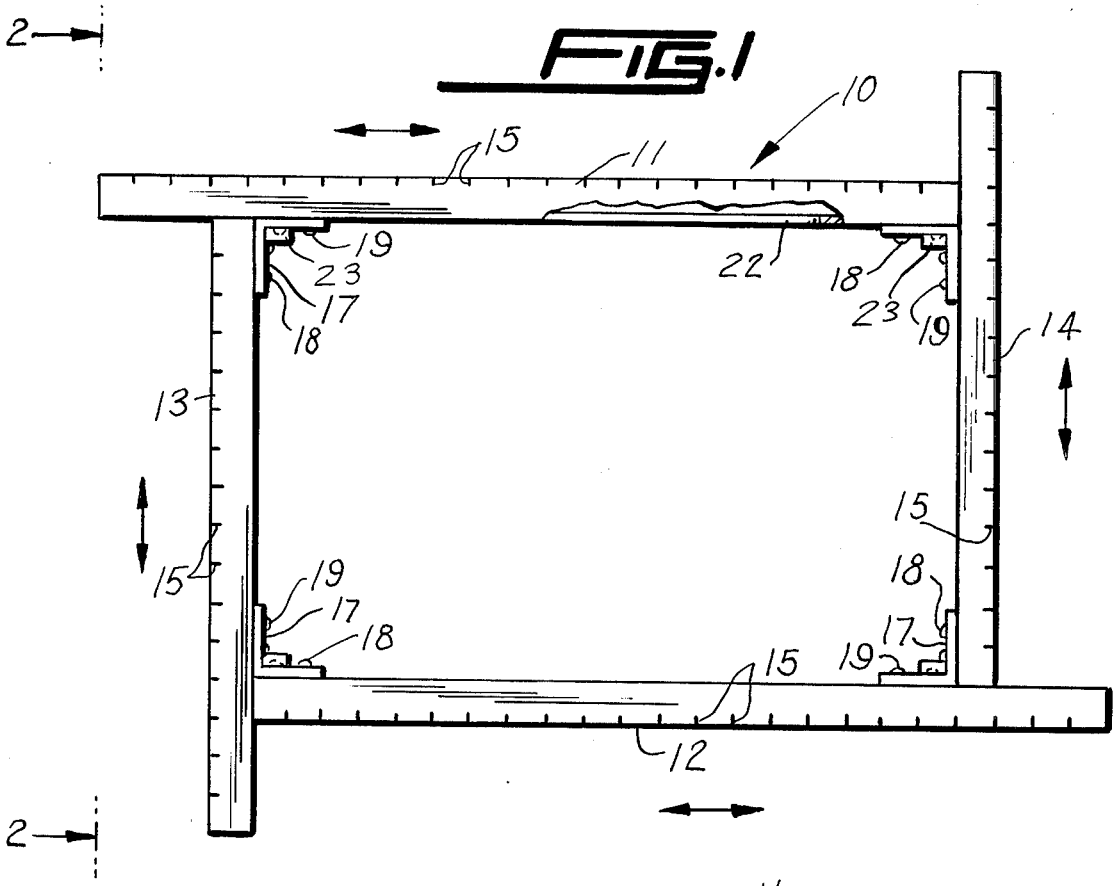
FIG. 1 is a front view of the present invention shown partly broken away and in elevation.
Figure 3:
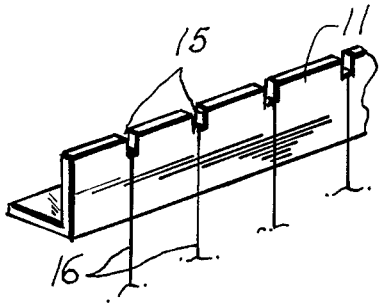
FIG. 3 is an enlarged fragmentary perspective view of one of the L-shaped members of the device showing how the cords are strung.
Figure 2:
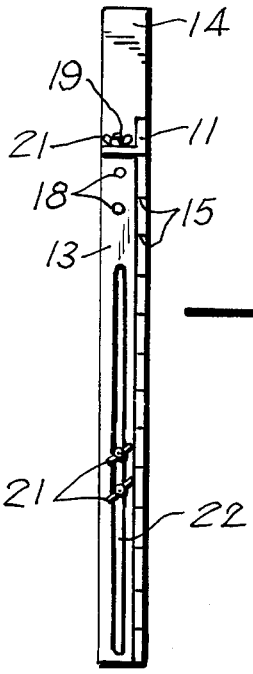
FIG. 2 is a left-hand view of FIG. 1.
Figure 4:
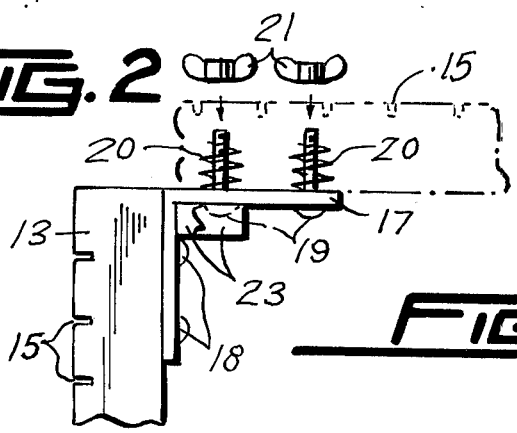
FIG. 4 is an enlarged fragmentary front view showing the spring loaded mounting of the device.

According to this invention, an adjustable grid line device 10 is shown to include parallel spaced apart and L-shaped configurated bars 11 and 12 and 13 and 14 which form a rectangular frame being adjustably secured to the outer peripheral edges of a canvas. All of the bars 11, 12, 13 and 14 are provided with equally spaced apart notches 15 on the outer peripheral longitudinal edges of the frame formed by the bars 11, 12, 13 and 14. The notches 15 receive thread 16 which is strung from bar 11 to bar 12 and from bar 13 to bar 14, the result being that a grid form of squares is obtained for enlarging or reducing, or copying pages, prints and the like. An L-shaped bracket 17 is secured by fasteners 18 within each internal corner formed by bars 11, 12, 13 and 14. The brackets 17 are one each, fastened fixedly, by means of fasteners 18 to bars 11, 12, 13 and 14 and the opposite ends of brackets 17 are free to slideably engage with their respective bars. A pair of threaded bolt fasteners 19 receive, each, a coil spring 20 and removeably receive a winged-nut fastener 21. Each of the bolt fasteners 19 are freely and slideably received within the elongated slot 22 of the bars 11, 12, 13 and 14 which enables the frame to be expanded or contracted as it is desired to fit various sized canvases. The spring 20 upon the bolt fasteners 19 provide tension means for the bars 11, 12, 13 and 14.

It shall be noted that each of the brackets 17 has secured fixedly thereto, a pair of spring clips 23 which are parallel spaced apart so as to receive the peripheral edges of the canvas within the frame of the device 10.

It shall be noted further that rather than thread 16, string, fishing line, thin wire and so on may be used and the beginning of thread 16 may have a knot tied into it and hooked into the first notch 15 to be used. The end of the thread after stringing is wrapped around a tack which is pushed into the canvas frame to hold thread 16 fast until the device 10 is finished with.

The notches 15 are one-quarter of an inch or more apart and the device may be threaded into the desired amount of grid squares.

In order to adjust the device 10, the winged nut fasteners 21 are loosened and the bars 11, 12, 13 and 14 are urged towards or away from each other as desired, whereupon the fasteners 21 are then tightened which will hold the canvas fast within the spring clips 23.

What I now claim is:

1. An adjustable grid line device comprising: a frame including two pairs of parallel spaced apart bars, each having an L-shaped cross-section and each having a plurality of equally spaced apart notches along the edges thereof corresponding to the outer peripheral edge of the frame; means for adjustably connecting the bars for the expansion and contraction of the frame comprising L-shaped brackets each fixedly secured on one outside face to one of the bars and means securing each bracket on the other outside face to an adjacent bar comprising a bolt fastener, means defining an elongated slot in the adjacent bar freely and slideably receptive of the bolt, a winged nut fastener engaged with the bolt fastener and spring means cooperative with the bolt fastener for urging the bracket against the adjacent bar; thread means received in said notches on the oppositely opposed bars to form grid lines for the enlarging, reducing or copying of pictures; and a pair of parallel spaced apart spring clips receptive of a canvas therebetween and fixedly secured to the inside corners of each bracket.

* * * * *

UNITED STATES PATENT OFFICE

CERTIFICATE OF CORRECTION

Patent No. 3,939,564 Dated February 24, 1976

Inventor(~~s~~) Walter V. Slawinski, Sr.

It is certified that error appears in the above-identified patent and that said Letters Patent are hereby corrected as shown below:

The correct name of the Inventor is as follows:

Walter V. Slawinski, Sr.

Signed and Sealed this twenty-fifth Day of May 1976

[SEAL]

*Attest:*

RUTH C. MASON
*Attesting Officer*

C. MARSHALL DANN
*Commissioner of Patents and Trademarks*